US006757925B1

(12) United States Patent
Toomer

(10) Patent No.: US 6,757,925 B1
(45) Date of Patent: Jul. 6, 2004

(54) MATTRESS ADJUSTING SYSTEM

(76) Inventor: John Reese Toomer, 2493 Independence La., Saint Cloud, FL (US) 34772

( * ) Notice: Subject to any disclaimer, the term of this patent is extended or adjusted under 35 U.S.C. 154(b) by 0 days.

(21) Appl. No.: 10/691,034

(22) Filed: Oct. 23, 2003

(51) Int. Cl.[7] ..... A47C 20/04
(52) U.S. Cl. ..... 5/660; 5/615; 5/509.1
(58) Field of Search ..... 5/610, 615, 509.1, 5/660

(56) References Cited

U.S. PATENT DOCUMENTS 3,606,623 A * 9/1971 Aymar ..... 5/660
4,142,263 A * 3/1979 Pierson ..... 5/660
4,807,313 A * 2/1989 Ryder et al. ..... 5/610
D340,829 S 11/1993 Neral
5,416,939 A 5/1995 Maalouli
5,425,150 A 6/1995 Palmer, Jr. et al.
5,522,099 A * 6/1996 Heier ..... 5/606
5,771,515 A * 6/1998 Carr ..... 5/660
6,681,425 B2 * 1/2004 Leventhal et al. ..... 5/660

* cited by examiner

*Primary Examiner*—Michael Trettel
(74) *Attorney, Agent, or Firm*—Ashkan Najafi

(57) ABSTRACT

A mattress adjusting system includes an inflatable air mattress having front and rear portions removably positionable between a mattress and a box spring. The air mattress includes a cavity for receiving air therein and for causing a bed mattress to tilt upwardly at the front portion thereof. The system further includes a pump mechanism for selectively inflating and deflating the air mattress and a weight member attached within the air mattress assisting to deflate same. The pump mechanism includes a control panel with a plurality of control buttons for causing air to selectively enter and exit the air mattress and a release valve for allowing an operator to manually deflate the mattress in the event of a power outage.

12 Claims, 2 Drawing Sheets

MATTRESS ADJUSTING SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a mattress adjusting system, and more particularly, to an inflatable mattress adjusting system for raising a mattress to a predetermined degree of inclination.

2. Prior Art

With the escalation of hospital costs, more emphasis is being placed on home health care in order to reduce the overall expense to the patient. In this regard, there are a number of disorders that can be readily treated at home, wherein the patient's discomfort is relieved or alleviated by having the patient supported in an inclined position, particularly during sleeping hours.

Two of these common disorders are hiatal hernias and acid reflux disease. Under these conditions, gastric juices produced by the stomach move upwardly along the esophagus when the patient is disposed in a reclined position. These gastric juices can cause extreme discomfort as well as ulceration and bleeding of the lower regions of the esophagus, a condition known as esophagitis. One of the methods of alleviating the discomfort caused by these disorders is to have the patient sleep in an inclined position, with the patient's head about eight inches above his/her feet. The inclination of the patient during sleeping prevents the gastric juices from migrating into the lower regions of the esophagus and is extremely effective in alleviating the discomfort occasioned due to these disorders.

While there are available on the market hospital-type beds for home use, these beds are expensive, somewhat unsightly, and do not fit into the normal bedroom decor or decorating scheme. The normal homeowner does not want his/her bedroom to look like a hospital room. Accordingly, a need remains for a mattress adjusting system that raises and lowers existing bedroom mattresses in order to alleviate the discomfort caused by gastric disorders when sleeping.

BRIEF SUMMARY OF THE INVENTION

In view of the foregoing background, it is therefore an object of the present invention to provide a system for raising and lowering a mattress. These and other objects, features, and advantages of the invention are provided by a system for adjusting the position of a bed mattress including an air mattress having front and rear portions removably positionable between a bed mattress and a box spring or frame. The air mattress includes a cavity adaptable for receiving air therein and for causing a bed mattress to tilt upwardly at the front portion. The system further includes a weight member preferably having a generally rectangular shape, for example, and being securely attached to an inner layer of the air mattress and front portion thereof for assisting to deflate same as needed by a user.

Advantageously, a user may more quickly deflate the air mattress than prior art air mattresses. The system further includes a pump mechanism connected to the front end thereof and for selectively inflating and deflating the air mattress.

The pump mechanism preferably includes a control panel with a plurality of control buttons extending upwardly therefrom and an air pump connected to the control panel and the air mattress for causing air to selectively enter or exit same. The air pump includes a power cord for connecting to a power outlet and is selectively operable by the plurality of control buttons. The control panel may further include a release valve for allowing an operator to manually deflate the air mattress in the event of a power outage.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
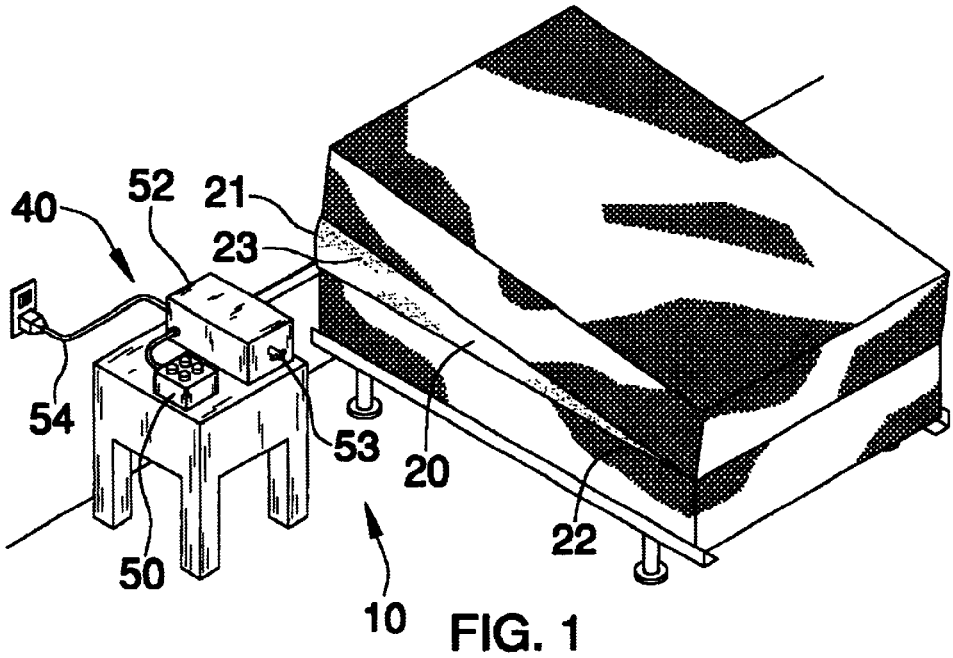
FIG. 1 is a perspective view showing a system for adjusting the position of a bed mattress, in accordance with the present invention.

The system of this invention is referred to generally in FIG. 1 by the reference numeral 10 and is intended to provide a system for adjusting the position of a bed mattress. It should be understood that the system 10 may be used to raise and lower many different types of objects and should not be limited to raising only bed mattresses.

Figure 2:
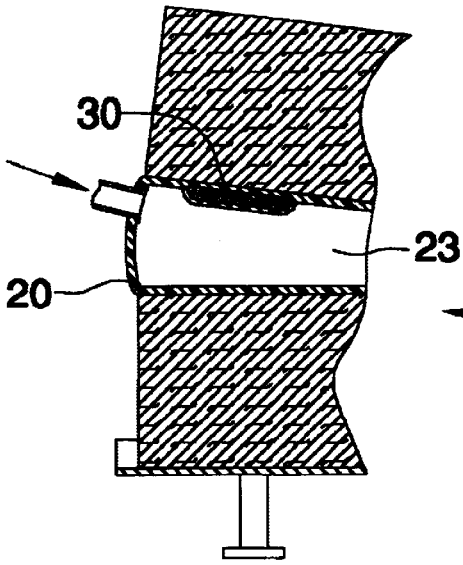
FIG. 2 is a cross-sectional view of the air mattress shown in FIG. 1 at an inflated position.
Figure 3:
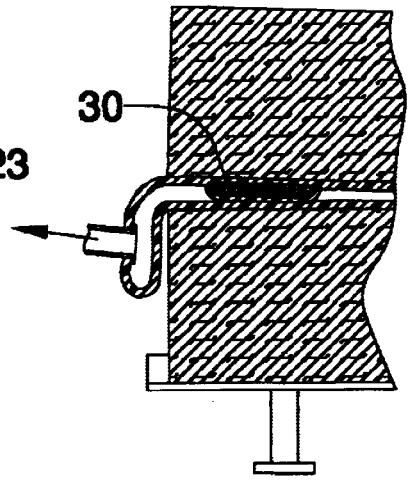
FIG. 3 is a cross-sectional view of the air mattress shown in FIG. 1 at a deflated position.

Referring initially to FIG. 1, the system 10 includes an air mattress 20 having front 21 and rear 22 portions and being removable positionable between a bed mattress and a box spring or frame. Now referring to FIGS. 2 and 3, the air mattress 20 includes a cavity 23 adaptable for receiving air therein and for causing a bed mattress to tilt upwardly at the front portion 21 thereof. The air mattress 20 includes a weight member 30 having a generally rectangular shape securely attached to an inner layer 21 of the air mattress 20 and disposed adjacent the front portion 21 thereof for assisting to deflate same as needed by a user. Of course, the air mattress 20 may be provided in many different shapes and sizes to accommodate the different size beds found in homes. Similarly, the weight member 30 may have alternate shapes and may be selectively positioned within the cavity 23.

Figure 4:
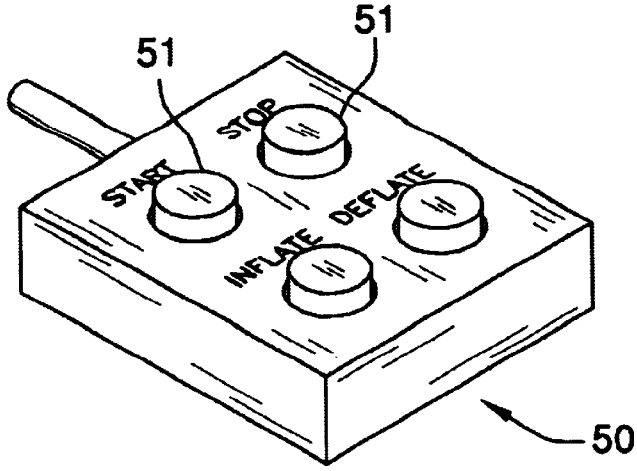
FIG. 4 is a perspective view of the control panel shown in FIG. 1.
Figure 5:
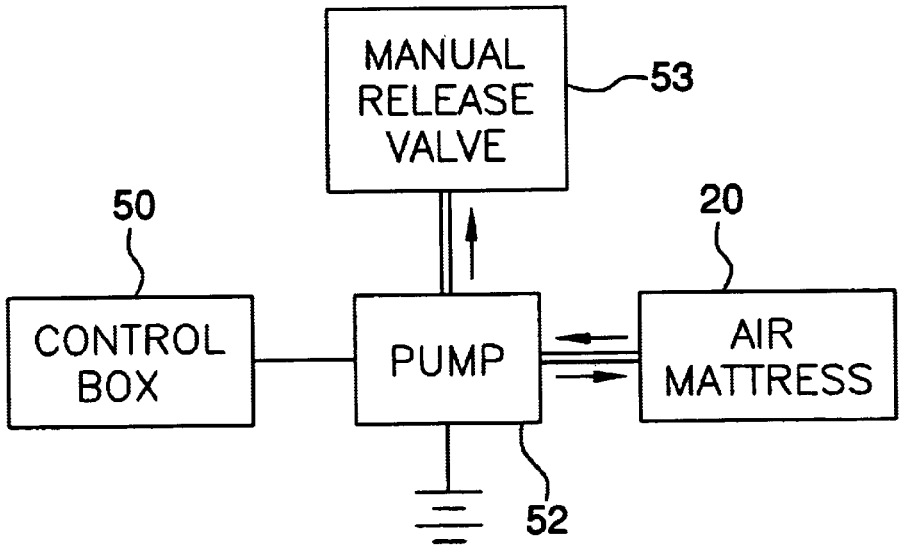
FIG. 5 is a schematic diagram of the system shown in FIG. 1.

Now referring to FIGS. 4 and 5, the system 10 further includes a pump mechanism 40 for selectively inflating and deflating the air mattress 20. Such a pump mechanism 40 is connected to the front portion 21 of the air mattress 20. The pump mechanism 40 includes a control panel 50 including a plurality of control buttons 51 extending upwardly therefrom and an air pump 52 connected to the control panel 50 and the air mattress 20 for causing air to selectively enter or exit same. The control panel 50 further includes a release valve 53 for allowing an operator to manually deflate the air mattress 20. Advantageously, the release valve 53 serves as an emergency back-up mechanism for deflating the air mattress 20 during a power outage or electrical malfunction of the control panel 50 or air pump 52. The air pump 52 further includes a power cord 54 for connecting to a conventional power outlet and for selectively supplying power to the system 10.

The system 10 provides a patient with the ability to selectively inflate an air mattress 20 for inclining a bed mattress to a desired degree of inclination for sleeping or relaxation, and thereafter deflate the air mattress 20 so that the bed mattress can assume a normal position at the time the bed is to be made or otherwise covered with a bedspread or the like. The system 10 is relatively inexpensive compared to hospital-type beds and yet provides a desired degree of inclination and comfort in a convenient and affordable manner.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A system for adjusting the position of a mattress and comprising:

an air mattress having front and rear portions and being removable positionable between a bed mattress and a box spring, said air mattress including a cavity and being adaptable for receiving air therein and for causing a bed mattress to tilt upwardly at said front portion;

a weight member connected to said air mattress and for assisting to deflate same as needed by a user, said weight member being disposed adjacent said front portion of said air mattress; and pump means for selectively inflating and deflating said air mattress and being connected to said front end thereof.

2. The system of claim 1, wherein said pump means comprises:

a control panel including a plurality of control buttons extending upwardly therefrom; and an air pump connected to said control panel and said air mattress and for causing air to selectively enter or exit same, said air pump including a power cord for connecting to a power outlet and being selectively operable by said plurality of control buttons.

3. The system of claim 2, wherein said control panel further comprises a release valve for allowing an operator to deflate said air mattress during a power outage.

4. The system of claim 1, wherein said weight member has a generally rectangular shape.

5. The system of claim 1, wherein said air mattress includes an inner layer with said weight member being securely attached thereto.

6. A system for adjusting the position of a mattress and comprising:

an air mattress having front and rear portions and being removable positionable between a bed mattress and a box spring, said air mattress including a cavity and being adaptable for receiving air therein and for causing a bed mattress to tilt upwardly at said front portion;

a weight member connected to said air mattress and for assisting to deflate same as needed by a user, said weight member being disposed adjacent said front portion of said air mattress; and pump means for selectively inflating and deflating said air mattress and being connected to said front end thereof, said pump means including a control panel including a plurality of control buttons extending upwardly therefrom, and an air pump connected to said control panel and said air mattress and for causing air to selectively enter or exit same, said air pump including a power cord for connecting to a power outlet and being selectively operable by said plurality of control buttons.

7. The system of claim 6, wherein said control panel further comprises a release valve for allowing an operator to deflate said air mattress during a power outage.

8. The system of claim 6, wherein said weight member has a generally rectangular shape.

9. The system of claim 6, wherein said air mattress includes an inner layer with said weight member being securely attached thereto.

10. A system for adjusting the position of a mattress and comprising:

an air mattress having front and rear portions and being removable positionable between a bed mattress and a box spring, said air mattress including a cavity and being adaptable for receiving air therein and for causing a bed mattress to tilt upwardly at said front portion;

a weight member connected to said air mattress and for assisting to deflate same as needed by a user, said weight member being disposed adjacent said front portion of said air mattress; and pump means for selectively inflating and deflating said air mattress and being connected to said front end thereof, said pump means including a control panel including a plurality of control buttons extending upwardly therefrom, said control panel further including a release valve for allowing an operator to deflate said air mattress during a power outage, and an air pump connected to said control panel and said air mattress and for causing air to selectively enter or exit same, said air pump including a power cord for connecting to a power outlet and being selectively operable by said plurality of control buttons.

11. The system of claim 10, wherein said weight member has a generally rectangular shape.

12. The system of claim 10, wherein said air mattress includes an inner layer with said weight member being securely attached thereto.

* * * * *